United States Patent [19]

Koseki et al.

[11] 4,134,375

[45] Jan. 16, 1979

[54] METHOD OF AND SYSTEM FOR CONTROLLING FUEL/AIR RATIO IN AN INTERNAL COMBUSTION ENGINE

[75] Inventors: Shyushi Koseki; Ken-ichi Koizumi, both of Yokosuka, Japan

[73] Assignee: Nissan Motor Company, Limited, Yokohama, Japan

[21] Appl. No.: 799,162

[22] Filed: May 23, 1977

[30] Foreign Application Priority Data

May 24, 1976 [JP] Japan ..... 51/589970

[51] Int. Cl.[2] ..... F02M 23/04; F02D 1/04; F02D 33/00

[52] U.S. Cl. ..... 123/119 EC; 123/119 D

[58] Field of Search ..... 123/119 EC, 119 D, 119 DB, 123/124 R, 124 B, 32 EE; 60/276

[56] References Cited

U.S. PATENT DOCUMENTS

| | | | |
|---|---|---|---|
| 3,921,612 | 11/1975 | Aono | 123/119 EC |
| 4,027,637 | 6/1977 | Aono | 123/119 D |
| 4,052,968 | 10/1977 | Hattori et al. | 123/124 B X |
| 4,056,932 | 11/1977 | Nakamura et al. | 123/119 D |
| 4,057,042 | 11/1977 | Aono | 123/119 EC |
| 4,065,920 | 1/1978 | Minami et al. | 123/119 EC |

*Primary Examiner*—Wendell E. Burns
*Attorney, Agent, or Firm*—Richard L. Schwaab

[57] ABSTRACT

In an internal combustion engine having a carburetor, a mixture ratio control system by means of which the fuel-to-air ratio of the combustible mixture to be produced in the carburetor is regulated toward a predetermined target value and furthermore the pressure in the fuel delivery circuit of the carburetor is temporarily increased or decreased at an incipient stage during a period of time for which the fuel-to-air ratio of the mixture as detected from the exhaust gases resulting from the mixture is reduced below or increased beyond the predetermined target value.

9 Claims, 11 Drawing Figures a
r
T $S_0$
Sr $S_1$
1
-1

$S_5$
1

$S_2$
$S_3$ $S_4$

METHOD OF AND SYSTEM FOR CONTROLLING FUEL/AIR RATIO IN AN INTERNAL COMBUSTION ENGINE

BACKGROUND OF THE INVENTION

The present invention relates in general to internal combustion engines for automotive vehicles and, particularly, to a method of controlling the fuel-to-air ratio of the combustible mixture in an automotive internal combustion engine for exhaust emission control purposes. The present invention is also concerned with an automotive internal combustion engine in which such a method is put into practice.

The chemical composition of exhaust gases from the power cylinders of an internal combustion engine is a faithful representation of the air-to-fuel ratio of the combustible mixture produced in the mixture supply system such as a carburetor of the engine. It has therefore been proposed and put into practice in some modernized versions of automotive internal combustion engines to have the fuel-to-air ratio of the combustible mixture controlled upon detection of the chemical composition of the exhaust gases from the power cylinders of an engine in an attempt to control exhaust emissions of the engine. A mixture ratio control system of this nature is useful especially when incorporated into an internal combustion engine of the type which is equipped with a thermal reactor or a catalytic converter in the exhaust system of the engine for re-combusting the combustible residues in the exhaust gases or converting specific types of toxic compounds such as hydrocarbons, carbon monoxide and nitrogen oxides in the exhaust gases into harmless compounds. As is well known in the art, a thermal reactor or a catalytic converter thus used to clean the exhaust gases of an internal combustion engine is adapted to exhibit its maximum performance efficiency when the exhaust gases passed therethrough have a specific chemical composition resulting from a predetermined fuel-to-air ratio such as typically a stoichiometric mixture ratio. For the purpose of achieving a maximum exhaust-gas cleaning efficiency in an internal combustion engine equipped with a thermal reactor or a catalytic converter in the exhaust system thereof, it is therefore important to have the air-to-fuel ratio of combustible mixture regulated to remain at a predetermined target value or within a certain range containing a predetermined target value that will result in exhaust gases having such a specific chemical composition throughout the various modes of operation or under prescribed modes of operation of the engine. The chemical composition of the exhaust gases to be detected is usually represented by the concentration of oxygen in the exhaust gases although the concentrations of other types of chemical components such as hydrocarbons, carbon monoxide and carbon dioxide are also closely related to the composition of the exhaust gases from an internal combustion engine.

A known mixture ratio control system adapted to regulate the fuel-to-air ratio toward a predetermined value in an automotive internal combustion engine using a carburetor as the mixture supply system has provided in the carburetor an extra air inlet passageway leading to a fuel delivery circuit of the carburetor and a solenoid-operated air-flow control valve which is adapted to close and open the air inlet passageway on the basis of digital signals representative of the chemical composition of the exhaust gases emitted from the power cylinders of the engine. The fuel to be delivered from the fuel delivery circuit and accordingly the fuel-to-air ratio of the combustible mixture to be finally produced in the carburetor are thus regulated by varying the flow rate of air to be injected into the fuel in the fuel delivery circuit through the additional air inlet passageway so that the suction developed in the fuel delivery circuit, viz., the motivating force to draw fuel from the fuel source is varied with the flow rate of air thus entering the fuel delivery circuit. When the fuel-to-air ratio of the combustible mixture produced in the carburetor is found to be lower than a predetermined target value or, in other words, the air-fuel mixture is found to be leaner than a mixture having a desired fuel-to-air ratio, the air-flow control valve is operated to close the air inlet passageway at an increased frequency and/or prolonged durations so as to reduce the flow rate of air through the air inlet passageway and enrich the air-fuel mixture to be produced in the carburetor until the fuel-to-air ratio of the mixture as monitored from the exhaust gases resulting from the mixture is found to have reached the target value. If, conversely, the fuel-to-air ratio of the combustible mixture produced in the carburetor is found to be higher than the predetermined target value, viz., the mixture is found to be richer than a mixture having the desired fuel-to-air ratio, then the air-flow control valve is operated to open up the air inlet passageway at a reduced frequency and/or for shortened durations so that air is injected into the fuel in the fuel delivery circuit at a reduced rate to produce enrichment of the air-fuel mixture until the fuel-to-air ratio of the mixture as monitored from the exhaust gases is found to have reached the target value.

In order to exploit the advantages of a mixture ratio control system of this nature, it is of critical importance that the delivery rate of fuel from the fuel delivery circuit be increased or decreased as fast as possible in response to a decrease or an increase, respectively, in the flow rate of air into the fuel delivery circuit. In a conventional mixture ratio control system of the described character, however, the motivating force to draw fuel from the fuel source is solely the suction developed in the fuel delivery circuit and, for this reason, the rate at which fuel is to be discharged from the fuel delivery circuit is varied only in response to changes in the degree of the suction in the circuit. Thus, the flow rate of fuel through the fuel delivery circuit cannot be increased or decreased instantaneously and distinctly in response to the flow of air into the fuel delivery circuit. This causes retardation in the changes in the fuel delivery rate in the carburetor and accordingly in the changes in the fuel-to-air ratio of the combustible mixture produced in the carburetor. The retardation in the changes in the fuel-to-air ratio results in fluctuations of the fuel-to-air ratio across the target value and critically impairs the potential function of the mixture ratio control system. The present invention contemplates elimination of such a drawback which is inherent in a prior-art mixture ratio control system of the described type.

SUMMARY OF THE INVENTION

It is, accordingly, a prime object of the present invention to provide a method of controlling the fuel-to-air ratio of the mixture in a carburetor of an automotive internal combustion engine in such a manner as to faithfully meet the requirements which vary from time to time depending upon the fuel-to-air ratio of the combustible mixture combusted in the power cylinders of the engine.

It is another prime object of the present invention to provide an automotive internal combustion engine in which such a method is put into practice.

In accordance with one important aspect of the present invention, there is provided a method of controlling the fuel-to-air ratio of the air-fuel mixture to be produced in an automotive internal combustion engine having a carburetor including a fuel delivery circuit, comprising detecting from the exhaust gases discharged from the power cylinders of the engine the fuel-to-air ratio of the air-fuel mixture produced in the carburetor and producing a control signal which is variable with the detected fuel-to-air ratio; injecting air into the fuel in the fuel delivery circuit at a rate variable with the control signal so that the fuel in the fuel delivery circuit is discharged therefrom at a rate which is variable with the rate of injection of air into the circuit, the control signal being such that the fuel-to-air ratio of the air-fuel mixture produced in the mixture supply system is constantly regulated toward a predetermined target value; detecting changes of the detected fuel-to-air ratio between a first range higher than said target value and a second range lower than the target value; and temporarily increasing or decreasing the pressure in the fuel delivery circuit for an incipient stage duringa period of time for which the detected fuel-to-air ratio is changed from the first range to the second range or from the second range to the first range, respectively. The pressure in the fuel delivery circuit may be decreased or increased respectively by increasing or decreasing the internal volume of the fuel delivery circuit. The aforesaid control signal is produced preferably by producing an analog signal continuously variable with the detected fuel-to-air ratio; comparing the analog signal with a predetermined reference signal representative of the above-mentioned predetermined target value for producing a binary signal having a logic "1" value when the analog signal is higher in magnitude than the reference signal and a logic "−1" value when the analog signal is lower in magnitude than the reference signal; producing a ramp signal linearly increasing in response to the binary signal having the logic "1" value and decreasing in response to the binary signal having the logic "−1" value; producing a train of steady-state triangular pulses; and comparing the ramp signal with the triangular signals for producing a train of square-shaped pulses as the above-mentioned control signal when the ramp signal is higher in magnitude than the triangular pulses. In this instance, the changes of the detected fuel-to-air ratio are preferably detected from the binary signal for producing a rectangular signal having a logic "1" value when the binary signal assumes the logic "1" value thereof and a logic "0" value when the binary signal assumes the logic "−1" value thereof. The pressure in the fuel delivery circuit may be decreased in response to the rectangular signal having the logic "1" value thereof and increased in response to the rectangular signal having the logic "0" value thereof.

In accordance with another important aspect of the present invention, there is provided in an automotive internal combustion engine having a carburetor including a fuel delivery circuit, a mixture ratio control system for controlling the fuel-to-air ratio of the air-fuel mixture to be produced in the carburetor, comprising air-inlet means for feeding air into the fuel delivery circuit; valve means disposed in the air-inlet means for controlling the flow rate of air through the air-inlet means so that the fuel in the fuel delivery circuit is discharged therefrom at a rate variable with the flow rate of air through the air-inlet means; detecting means for detecting from the exhaust gases discharged from the power cylinders of the engine the fuel-to-air ratio of the air-fuel mixture produced in the carburetor; a control circuit operative to produce a first output signal variable with the detected fuel-to-air ratio and a second output signal indicative of changes of the detected fuel-to-air ratio between a first range higher than a predetermined target value and a second range lower than the predetermined target value, the first output signal being supplied to the valve means for controlling the flow rate of air through the valve means in such a manner that the fuel-to-air ratio of the air-fuel mixture to be produced in the carburetor is constantly regulated toward the predetermined target value, and transient fuel-delivery control means responsive to the second output signal for temporarily increasing or decreasing the pressure in the fuel delivery circuit for an incipient stage during a period of time for which the detected fuel-to-air ratio is changed from the first range to the second range or from the second range to the first range, respectively. The above-mentioned transient fuel-delivery control means preferably comprises a diaphragm assembly including a flexible diaphragm forming a variable-volume fuel reservoir chamber which has minimum and maximum volume conditions and which forms part of the fuel delivery circuit and a solenoid-operated plunger connected to the diaphragm and movable between positions corresponding to the minimum and maximum volume conditions of the variable-volume fuel reservoir chamber, the diaphragm assembly being electrically connected to the control circuit for being responsive to the second output signal from the circuit so that the solenoid-operated plunger is moved into the position corresponding to the minimum volume condition of the fuel reservoir chamber in response to the second output signal indicative of a change of the detected fuel-to-air ratio from the first range to the second range and into the position corresponding to the maximum volume condition of the fuel reservoir chamber in response to the second output signal indicative of a change of the detected fuel-to-air ratio from the second range to the first range.

The fuel delivery circuit in the method and arrangement according to the present invention as hereinbefore mentioned may be constituted at least in part by the usual main fuel delivery circuit, a low-speed and idling fuel delivery circuit or the combination of these circuits of an internal combustion engine.

BRIEF DESCRIPTION OF THE DRAWINGS

The features and advantages of the method according to the present invention and an automotive internal combustion engine to put such a method into practice will be more clearly understood from the following description taken in conjunction with the accompanying drawings, in which.

DETAILED DESCRIPTION OF PREFERRED EMBODIMENTS

Figure 1:
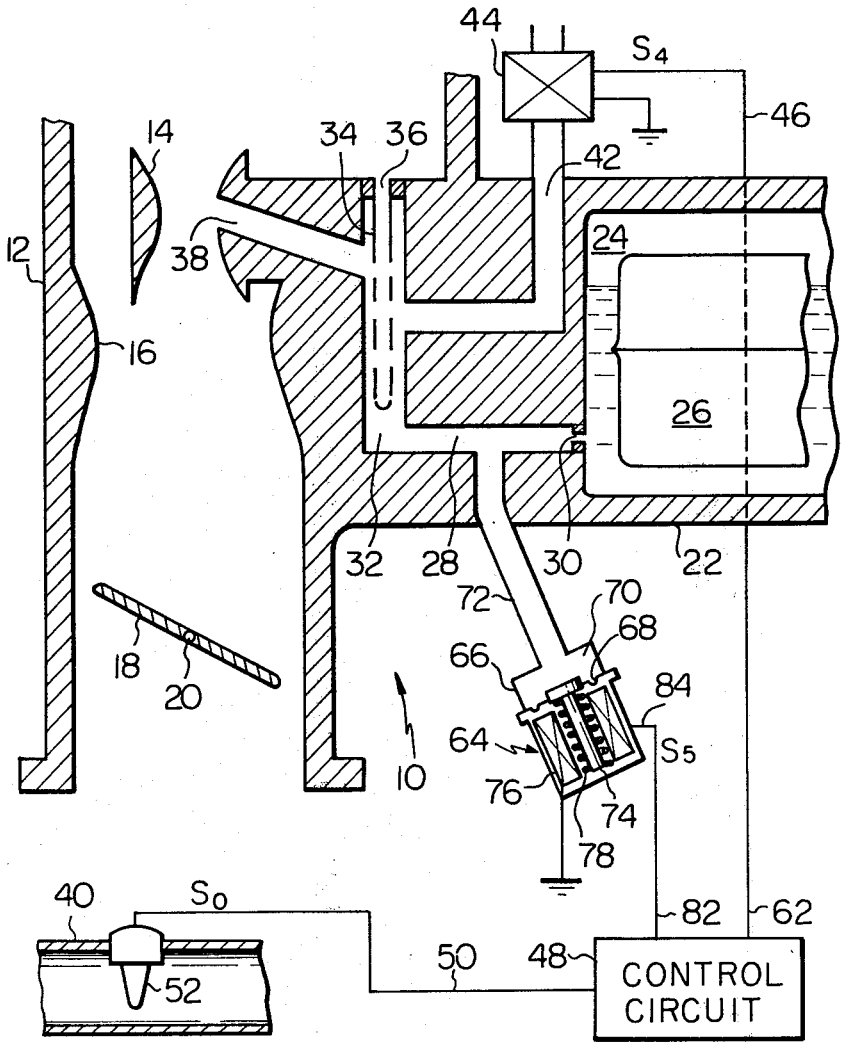
FIG. 1 is a schematic sectional view showing, partly in a block diagram, a preferred embodiment of the automotive internal combustion engine according to the present invention.

Referring to FIG. 1 of the drawings, an automotive internal combustion engine embodying the present invention has a carburetor 10 which is shown, by way of example, as being of the double venturi type having a mixture delivery pipe 12 formed with a primary venturi 14 and a secondary venturi 16. The carburetor 10 further comprises a throttle valve 18 which is rotatable with a shaft 20 located downstream of the secondary venturi 16. Though not shown, the throttle valve shaft 20 is connected by a mechanical linkage to the accelerator pedal of the vehicle and is moved between fully open and closed positions through a part throttle position from the accelerator pedal, as is well known. The mixture delivery pipe 12 is connected between an air cleaner through an air horn located upstream of the primary venturi 14 and an intake manifold located downstream of the throttle valve 18, though not shown. The intake manifold in turn leads to the power cylinders of the engine through valved intake ports formed in the cylinder head of the engine, as is also well known.

The carburetor 10 has an emulsion block 22 formed with a main fuel delivery circuit which originates in a carburetor float bowl 24 having a float 26 positioned therewithin. Though not shown, the float bowl 24 is in communication with a fuel storage tank through a flow control valve operated by the float 26 and has stored therein liquid fuel pumped from the fuel storage tank, as is also well known inthe art. The fuel delivery circuit comprises a main fuel feed passageway 28 leading from a bottom portion of the float bowl 24 through a main fuel metering jet 30. The fuel feed passageway 28 terminates in a main fuel well 32 having a perforated atomizer tube 34 which is vented from the open air through an air bleed port 36. A main fuel discharge nozzle 38 leads from the fuel well 32 and opens into the mixture delivery pipe 12 through the primary venturi 14 as is customary. Though not shown, the emulsion block 22 is further formed with a low-speed fuel delivery circuit which usually comprises a low-speed fuel discharge port which is open into the mixture delivery pipe 12 slightly upstream of the throttle valve 18 in the fully closed position thereof and an idling fuel discharge port which opens into the mixture delivery pipe 12 slightly downstream of the throttle valve 18 in the fully closed position. The low-speed and idling fuel discharge ports are in communication with the main fuel feed passageway 28 through a low-speed fuel well and pass fuel into the mixture delivery pipe 12 at limited rates when the throttle valve is in a fully closed or slightly open position.

The internal combustion engine further comprises an exhaust system including an exhaust pipe 40 connected upstream to an exhaust manifold leading from the power cylinders of the engine through valved exhaust ports formed in the cylinder head of the engine, though not shown.

The exhaust system of the engine is assumed to be arranged with a catalytic converter (not shown) which is adapted to convert hydrocarbons, carbon monoxide and nitrogen oxides in the exhaust gases from the power cylinders of the engine into harmless compounds. As previously noted, the catalytic converter of this nature is enabled to exhibit a maximum conversion efficiency when the exhaust gases passed therethrough have resulted from a combustible mixture having a predetermined fuel-to-air ratio.

Figure 2:
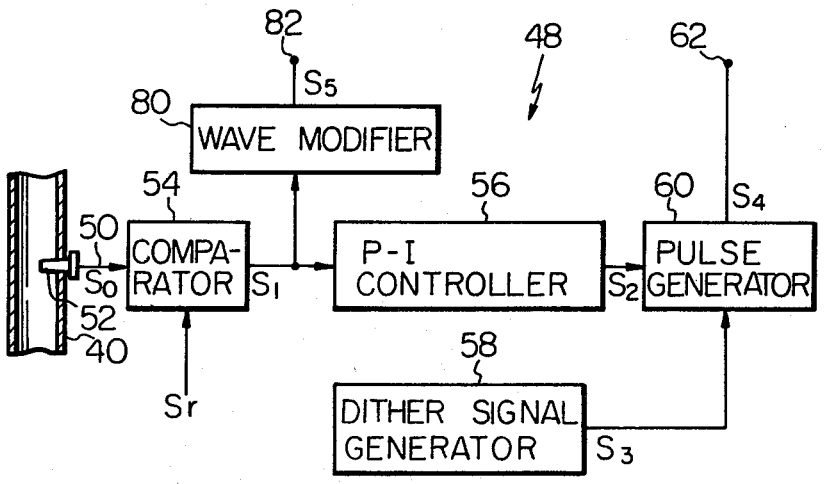
FIG. 2 is a block diagram showing a preferred example of the electric control circuit which is incorporated into the embodiment illustrated in FIG. 1.

To produce such an air-fuel mixture in the mixture delivery pipe 12, the carburetor 10 is arranged with a mixture ratio control system which is adapted to control the flow rate of the fuel to be injected into the mixture delivery pipe 12 through the fuel discharge nozzle 38. Such a mixture ratio control system comprises an air inlet passageway 42 vented from the open air and terminating in the fuel well 32. The air inlet passageway 42 is provided with a solenoid-operated, two-position air-flow control valve 44 which is arranged to remain closed when de-energized and to be open when energized. The air-flow control valve 44 has a solenoid coil (not shown) which is connected by a line 46 to a control circuit 48 having an input terminal connected by a line 50 to an exhaust gas sensor 52 disposed in the exhaust pipe 40 of the engine preferably upstream of the catalytic converter (not shown) which is assumed to be provided in the exhaust system as previously-noted. The exhaust gas sensor 52 is herein assumed, by way of example, to be of the type which is operable to detect the concentration of oxygen in the exhaust gases passed through the exhaust pipe 40 and to produce an analog output signal So which varies with the detected concentration of the oxygen content in the exhaust gases. The concentration of oxygen in exhaust gases is a faithful representation of the proportion of the quantity of air in an air-fuel mixture as previously noted and the analog output signal produced by an usual oxygen-sensitive exhaust gas sensor is approximately inversely proportional to the concentration of oxygen in the exhaust gases passed through the sensor when the combustible mixture resulting in the exhaust gases is proportioned to have a fuel-to-air ratio approximating a stoichiometric mixture ratio as is well known in the art. The analog output signal produced by the sensor 52 is therefore not only indicative of the concentration of air in the air-fuel mixture which has resulted in the exhaust gases passed through the sensor but represents the fuel-air-ratio of the mixture. FIG. 2 shows a preferred example of the control circuit 48 which is thus adapted to control the air-flow control valve 44 in accordance with the analog output signal So delivered from the exhaust gas sensor 52.

Figures 3A, 3B, 3C, 3D, 3E, 3F:
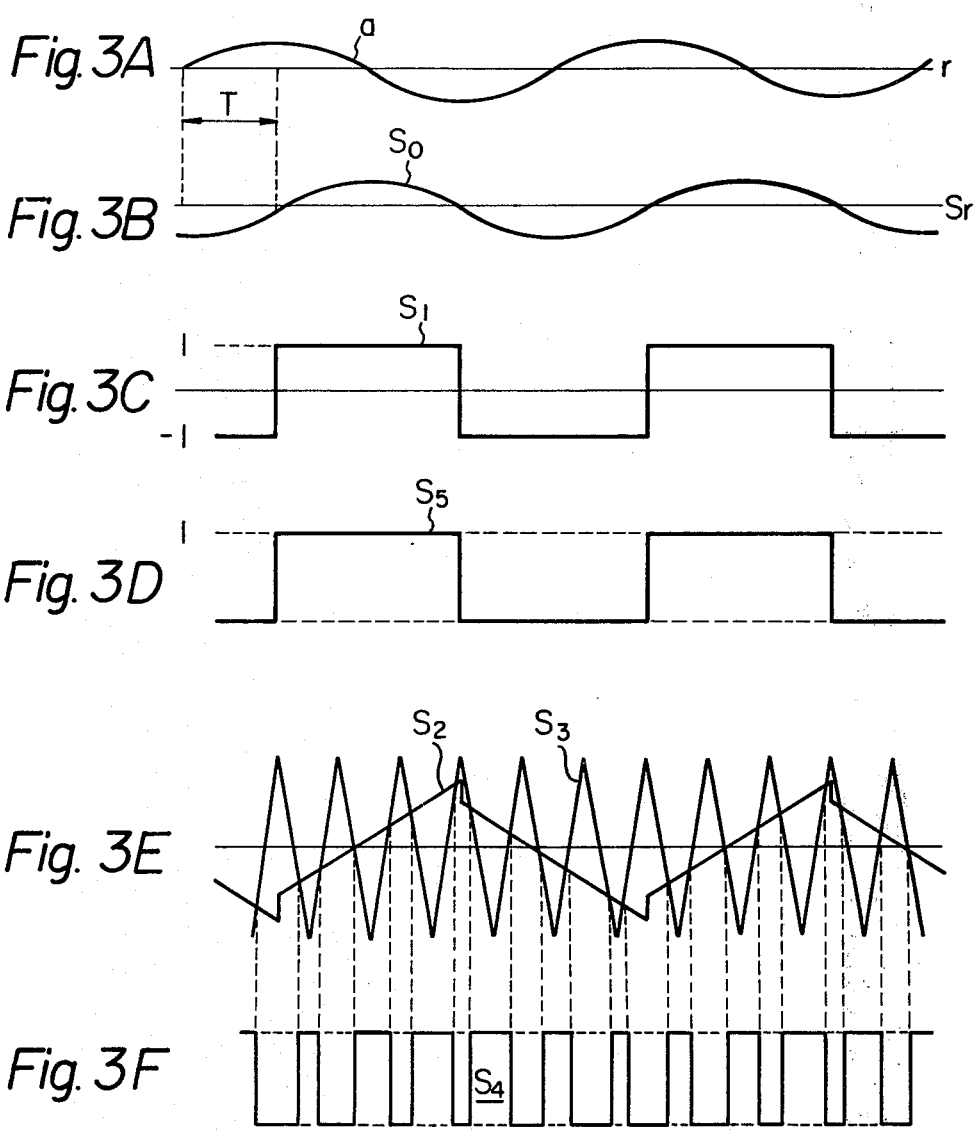
FIGS. 3A to 3F are graphs showing the waveforms of the various signals produced in the control circuit illustrated in FIG. 2.

Referring to FIG. 2, the control circuit 48 is shown comprising a comparator 54, a P-I controller 56, a triangular dither signal generator 58 and a control pulse generator 60. The comparator 54 has a first input terminal connected by the line 50 to the output terminal of the above described exhaust gas sensor 52 and a second input terminal connected to a suitable source (not shown) of a fixed reference signal Sr which is representative of a predetermined concentration of oxygen in exhaust gases resulting from a combustible mixture proportioned to a fuel-to-air ratio of a desired target value. The comparator 54 thus supplied with the analog signal So and the fixed reference Signal Sr is operative to compare the signals So and Sr with each other and produce a binary output signal $S_1$ which assumes a logic "1" value when the signal So from the exhaust gas sensor 52 is greater in magnitude than the reference signal Sr, i.e., the detected concentration of oxygen in the exhaust gases passed through the sensor 52 is lower than the predetermined value and a logic "−1" value when the signal So is less in magnitude than the reference signal Sr, i.e., the detected concentration of oxygen in the exhaust gases is higher than the predetermined value, as will be seen from FIGS. 3B and 3C. In FIG. 3A is shown a curve a which indicates variation of the fuel-to-air ratio of the air-fuel mixture produced in the carburetor 10 across a predetermined reference value r which corresponds to the predetermined value of the concentration of oxygen in the exhaust gases. The output signal $S_1$ of the comparator 54 is fed to the P-I controller 56 adapted to produce a ramp signal $S_2$ which is composed of a component proportional to the input signal and a component corresponding to the integral of the input signal and which increases in response to the input signal $S_1$ having the logic "1" value and decreases in response to the input signal $S_1$ having the logic "−1" value, as will be seen from FIGS. 3C and 3E. On the other hand, the triangular dither signal generator 58 is operative to produce a train of triangular pulses $S_3$ with a fixed pulsewidth and at a constant frequency as shown in FIG. 3E. The ramp signal $S_2$ from the P-I controller 56 and the triangular pulses $S_3$ from the dither signal generator 58 are supplied to the control pulse generator 60. The control pulse generator 60 is, in effect, a comparator and is adapted to compare the ramp signal $S_2$ with the dither signals $S_3$ so as to produce a train of square-shaped control pulses $S_4$ when the former is higher in magnitude than the latter, as will be seen from FIGS. 3E and 3F. The control pulse generator 60 has an output terminal 62 from which the pulses $S_4$ thus produced are fed to the solenoid coil of the air-flow control valve 44 shown in FIG. 1.

Turning back to FIG. 1, the air-flow control valve 44 is alternately energized and de-energized by the control pulses $S_4$ which are passed in succession to the solenoid coil of the valve 44 through the line 46. The valve 44 is accordingly actuated to open at intervals which are dictated by the control pulses $S_4$ delivered from the control circuit 48. The flow rate of air through the air inlet passageway 42 is thus controlled in a digital fashion so that the delivery rate of fuel from the main fuel delivery circuit is regulated to constantly approach a target value which corresponds to the predetermined value of the concentration of oxygen in the exhaust gases passed through the exhaust pipe 40.

From comparison between FIGS. 3A and 3B it will be seen that the fuel-to-air ratio represented by the output signal So of the exhaust gas sensor 52 is actually representative of the fuel-to-air ratio of the mixture produced in the carburetor 10 at a certain point of time before the signal So is delivered from the sensor 52 so that there is a time lag T until the actual fuel-to-air ratio of the mixture produced in the carburetor 10 is monitored by the exhaust gas sensor 52. This means that, if the fuel delivery rate of the main fuel delivery circuit of the carburetor 10 is controlled merely in accordance with the control pulses $S_4$ delivered from the output terminal 62 of the control circuit 48, the air-fuel mixture produced in the carburetor 10 is excessively enriched or leaned out at a point of time when the signal So produced by the exhaust gas sensor 52 is indicative of a fuel-to-air ratio which is becoming higher (with the mixture becoming richer) or lower (with the mixture becoming leaner), respectively, than the predetermined target value r. The gist of the present invention is to eliminate such a drawback by accelerating an increase or a decrease in the fuel delivery rate from the main fuel delivery circuit when the signal So produced by the exhaust gas sensor 52 is indicative of a fuel-to-air ratio which is on the point of exceeding or falling short of a predetermined target value.

To achieve such an end, the mixture ratio control system embodying the present invention further comprises transient fuel-delivery control means which is adapted to momentarily vary the back pressure to be applied to the fuel in the main fuel delivery circuit for temporarily increasing or decreasing the delivery rate of fuel from the main fuel delivery circuit at a transient stage after the air-fuel mixture which has been excessively lean or rich is found to have enriched or leaned out beyond a predetermined level. In FIG. 1, the transient fuel-delivery control means is shown comprising a solenoid-operated diaphragm assembly 64 having a casing 66 and a flexible diaphragm 68 forming a variable-volume fuel reservoir chamber 70. The variable-volume fuel reservoir chamber 70 is in constant communication through a passageway 72 with the fuel feed passageway 28 downstream of the main fuel jet 30. The diaphragm assembly 64 further includes solenoid-operated actuating means comprising a solenoid plunger 74 and a solenoid coil 76 which are housed in the casing 66 and which are positioned on the opposite side of the diaphragm 68 to the fuel reservoir chamber 70. The solenoid plunger 74 is fastened at one axial end to the diaphragm 68 and is urged to axially move in a direction to contract the variable-volume fuel reservoir chamber 70 by suitable biasing means such as a preloaded helical compression spring 78 which is also housed within the casing 66 and positioned on the opposite side of the diaphragm 68 to the reservoir chamber 70. The plunger 74 is axially moved in the opposite direction to expand the variable-volume fuel reservoir chamber 70 when the solenoid coil 76 is energized.

Referring again to FIG. 2, the control circuit 48 further comprises a wave modifier 80 having an input terminal connected to the output terminal of the previously described comparator 54 and an output terminal 82 which is connected by a line 84 to the solenoid coil 76 of the diaphragm assembly 64. The wave modifier 80 is adapted to modify the output signal $S_1$ of the comparator 54 into a binary signal $S_5$ having logic "1" and "0" values when the input signals $S_1$ assume the logic "1" and "−1" values, respectively, thereof, as will be seen from FIGS. 3C and 3D. The wave modifier 80 is thus operative to produce the binary signal $S_5$ having the logic "1" and "0" values when the fuel-to-air ratio monitored by the exhaust gas sensor 52 is higher and lower, respectively, than the predetermined target value r. The solenoid coil 76 of the diaphragm assembly 64 is energized and de-energized in response to the logic "1" and "0" values, respectively, of the binary output signal $S_5$ of the wave modifier 80. In the presence of the signal $S_5$ having the logic "1" value at the output terminal 82 of the control circuit 48, the solenoid coil 76 of the diaphragm assembly 64 remains energized so that the diaphragm 68 of the diaphragm assembly 64 is held in the position expanding the variable-volume fuel reservoir chamber 70 against the force of the preloaded compression spring 78. Fuel is therefore discharged from the main fuel delivery circuit into the mixture delivery pipe 12 at a rate which is regulated by means of the air-flow control valve 44 in accordance with the control pulses $S_4$ delivered from the first output terminal 62 of the control circuit until the fuel-to-air ratio of the resultant mixture of air and fuel is reduced to the predetermined target value r.

Figure 4:
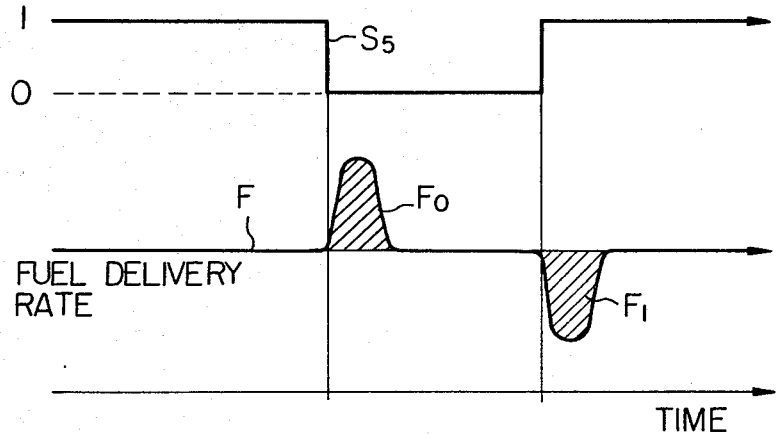
FIG. 4 is a graph showing an example of fuel delivery characteristics which are achieved in the carburetor of an internal combustion engine embodying the present invention.

When the fuel-to-air ratio which is thus diminished under the control of the air-flow control valve 44 is reduced below the predetermined target value r and as a consequence the output signal So of the exhaust sensor 52 becomes lower in magnitude than the reference signal Sr impressed on the comparator 54, then the binary output signal $S_5$ of the wave modifier 80 assumes the logic "0" value thereof and causes the solenoid coil 76 of the diaphragm assembly 64 to be de-energized. The plunger 74 and the diaphragm 68 of the diaphragm assembly 64 are therefore moved in the directions to contract the variable-volume fuel reservoir chamber 70 to a minimum volume condition by the force of the preloaded compression spring 78 with the result that the back pressure on the fuel in the main fuel delivery circuit is suddenly increased by an amount which corresponds to the decrement in the volume of the fuel reservoir chamber 70. Fuel in the main fuel delivery circuit is discharged into the mixture delivery pipe 12 from the fuel discharge nozzle 38 at a rate which is abruptly increased at an incipient stage during the period of time for which the wave modifier 80 is producing the output signal $S_5$ having the logic "0" value, as indicated by an upwardly convex section Fo of the curve F illustrated in FIG. 4. On the other hand, the comparator 54 is producing the output signal $S_1$ having the logic "−1" value so that the air-flow control valve 44 is operative to pass air therethrough at a reduced rate until the fuel-to-air ratio of the combustible mixture as monitored by the exhaust gas sensor 52 reaches the predetermined target value r.

When the fuel-to-air ratio of the mixture which is in this fashion enriched by means of the control valve 44 exceeds the predetermined target value r and as a consequence the comparator 54 produces the output signal $S_1$ having the logic "1" value, then the binary output signal $S_5$ of the wave modifier 80 is altered to the logic "1" value and energizes the solenoid coil 76 of the diaphragm assembly 64. This causes the plunger 74 and diaphragm 68 of the diaphragm assembly 64 to move in the directions to expand the variable-volume fuel reservoir chamber 70 from the minimum volume condition thereof against the force of the preloaded compression spring 78. It therefore follows that the back pressure on the fuel in the main fuel delivery circuit is suddenly reduced by an amount which corresponds to the increment in the volume of the fuel reservoir chamber 70. Fuel in the main fuel delivery circuit is thus discharged into the mixture delivery pipe 12 at a rate which is abruptly reduced at an incipient stage during the period of time for which the wave modifier 80 is producing the output signal $S_5$ having the logic "1" value, as indicated by a downwardly concave section $F_1$ of the curve F shown in FIG. 4. The comparator 54 being in a condition producing the output signal $S_1$ having the logic "1" value, the air-flow control valve 44 is operative to pass air therethrough at an increased rate until the fuel-to-air ratio of the mixture as monitored from the exhaust gases by means of the exhaust sensor 52 reaches the predetermined target value r.

Figure 5A:
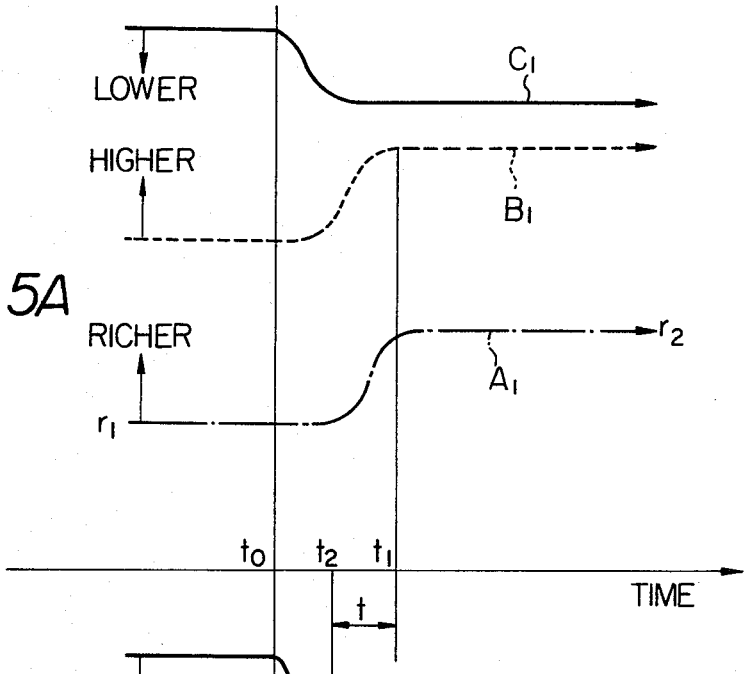
FIG. 5A is a graph showing an example of the relationship among the fuel-to-air ratio of combustible mixture as monitored from the exhaust gases, the fuel delivery rate from the fuel delivery circuit and the flow rate of air into the circuit as observed in an internal combustion engine using a prior-art mixture ratio control system.
Figure 5B:
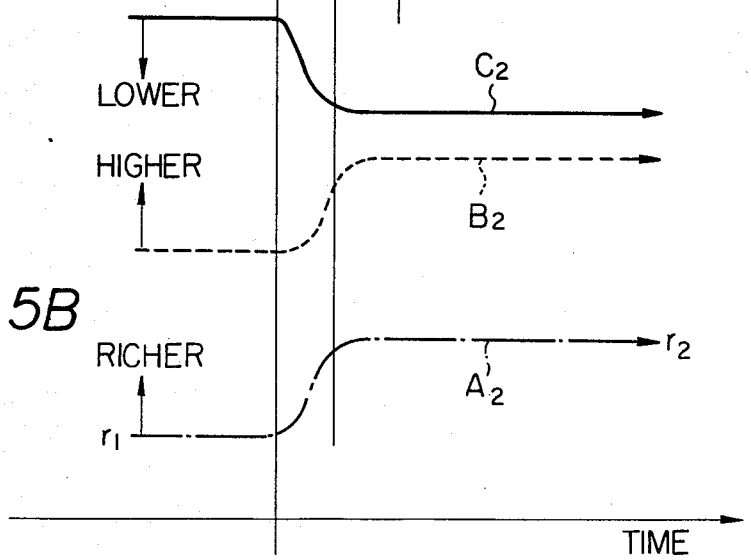
FIG. 5B is a graph which shows an example of the similar relationship in an internal combustion engine embodying the present invention.

FIG. 5A shows the relationship among the fuel-to-air ratio $A_1$ of the air-fuel mixture as monitored from the exhaust gases, the delivery rate $B_1$ of fuel from the fuel delivery circuit and the flow rate $C_1$ of air injected into the fuel delivery circuit when the detected fuel-to-air ratio which has been reduced to a level $r_1$ lower than a predetermined target value is increased to a level $r_2$ higher than the target value in an internal combustion engine having a carburetor arranged with a known mixture ratio control system includingvalved air-inlet means for the fuel delivery circuit of the carburetor but void of transient fuel-delivery control means of the nature proposed by the present invention. FIG. 5B illustrates a similar relationship among the fuel-to-air ratio $A_2$, fuel delivery rate $B_2$ and air flow rate $C_2$ as observed in an internal combustion engine embodying the present invention. In FIGS. 5A and 5B, $t_o$ indicates the time at which the detected fuel-to-air ratio $A_1$ or $A_2$ is reduced to the level $r_1$ lower than the predetermined target value, while $t_1$ indicates the time at which the detected fuel-to-air ratio $A_1$ in the internal combustion engine using the conventional mixture ratio control system is increased to the level $r_2$ higher than the predetermined target value and $t_2$ indicates such a point of time achieved in the internal combustion engine according to the present invention. Comparison between FIGS. 5A and 5B reveals that the level $r_2$ of the fuel-to-air ratio can be reached earlier by t in the internal combustion engine according to the present invention than in the internal combustion engine arranged with the prior-art mixture ratio control system. Such a difference t between the time $t_1$ and time $t_2$ apparently has resulted from a temporary increment in the back pressure on the fuel in the fuel delivery circuit in the internal combustion engine according to the present invention.

While the mixture ratio control system embodying the present invention has been described as having the transient fuel-delivery control means provided in association with the main fuel delivery circuit of the carburetor, such means may be provided in conjunction with the low-speed and idling fuel delivery circuit or with both of the main and low-speed fuel delivery circuits if desired.

What is claimed is:

1. A method of controlling the fuel-to-air ratio of the air-fuel mixture to be produced in an automotive internal combustion engine having a carburetor including a fuel delivery circuit, comprising the steps of:

(1) detecting from the exhaust gases discharged from the power cylinders of the engine the fuel-to-air ratio of the air-fuel mixture produced in the carburetor and producing a control signal variable with the detected fuel-to-air ratio;

(2) injecting air into the fuel in the fuel delivery circuit at a rate variable with said control signal so that the fuel in the fuel delivery circuit is discharged therefrom at a rate variable with the rate of injection of air into the circuit, said control signal being such that the fuel-to-air ratio of the air-fuel mixture to be produced in the carburetor is constantly regulated toward a predetermined target value;

(3) detecting changes of the detected fuel-to-air ratio between a first range higher than said target value and a second range lower than the target value; and (4) temporarily increasing or decreasing the pressure in said fuel delivery circuit for an incipient stage during a period of time for which the detected fuel-to-air ratio is changed from said first range to said second range or from said second range to said first range, respectively.

2. A method as set forth in claim 1, in which the pressure in the fuel delivery circuit is decreased or increased respectively by increasing or decreasing the internal volume of the fuel delivery circuit by a predetermined amount.

3. A method as set forth in claim 1, in which said control signal is produced by producing an analog signal continuously variable with the detected fuel-to-air ratio; comparing the analog signal with a predetermined reference signal representative of said predetermined target value for producing a binary signal having a logic "1" value when said analog signal is higher in magnitude than said reference signal and a logic "−1" value when the analog signal is lower in magnitude than the reference signal; producing a ramp signal linearly increasing in response to the binary signal having the logic "1" value and decreasing in response to the binary signal having the logic "−1" value; producing a train of steady-state triangular pulses; and comparing said ramp signal with said triangular signals for producing a train of square-shaped pulses as said control signal when said ramp signal is higher in magnitude than said triangular pulses.

4. A method as set forth in claim 3, in which said changes of the detected fuel-to-air ratio are detected from said binary signal for producing a rectangular signal which has a logic "1" value when said binary signal assumes the logic "1" value thereof and a logic "0" value when said binary signal assumes the logic "−1" value thereof.

5. A method as set forth in claim 4, in which said pressure in said fuel delivery circuit is decreased in response to said rectangular signal having the logic "1" value thereof and increased in response to said rectangular signal having the logic "0" value thereof.

6. In an automotive internal combustion engine having a carburetor including a fuel delivery circuit, a mixture ratio control system for controlling the fuel-to-air ratio of the air-fuel mixture to be produced in the carburetor, comprising:

(a) air-inlet means for feeding air into said fuel delivery circuit;

(b) valve means disposed in said air-inlet means for controlling the flow rate of air through the air-inlet means so that the fuel in the fuel delivery circuit is discharged therefrom at a rate variable with the flow rate of air through the air-inlet means;

(c) detecting means for detecting from the exhaust gases discharged from the power cylinders of the engine the fuel-to-air ratio of the air-fuel mixture produced in the carburetor;

(d) a control circuit operative to produce a first output signal variable with the detected fuel-to-air ratio and a second output signal indicative of changes of the detected fuel-to-air ratio between a first range higher than a predetermined target value and a second range lower than the predetermined target value, the first output signal being supplied to said valve means for controlling the flow rate of air through the valve means in such a manner that the fuel-to-air ratio of the air-fuel mixture to be produced in the carburetor is constantly regulated toward said predetermined target value; and (e) transient fuel-delivery control means responsive to said second output signal for temporarily increasing or decreasing the pressure in said fuel delivery circuit for an incipient stage during a period of time for which the detected fuel-to-air ratio is changed from said first range to said second range or from said second range to said first range, respectively.

7. A mixture ratio control system as set forth in claim 6, in which said transient fuel-delivery control means comprises a diaphragm assembly including a flexible diaphragm forming a variable-volume fuel reservoir chamber which has minimum and maximum volume conditions and which forms part of said fuel delivery circuit and a solenoid-operated plunger connected to said diaphragm and movable between positions, respectively, corresponding to the minimum and maximum volume conditions of the variable-volume fuel reservoir chamber, said diaphragm assembly being electrically connected to said control circuit for being responsive to said second output signal from the circuit so that said solenoid-operated plunger is moved into the position corresponding to the minimum volume condition of the fuel reservoir chamber in response to the second output signal indicative of a change of the detected fuel-to-air ratio from said first range to said second range and into the position corresponding to the maximum volume condition of the fuel reservoir chamber in response to the second output signal indicative of a change of the detected fuel-to-air ratio from said second range to said first range.

8. A mixture ratio control system as set forth in claim 7, in which said detecting means is operative to produce an analog output signal continuously variable with the detected fuel-to-air ratio and in which said control circuit comprises a comparator having a first input terminal connected to said detecting means and a second input terminal connected to a source of a reference signal representative of said predetermined target value, said comparator being operative to compare the output signal from the detecting means with said reference signal for producing a binary signal having a logic "1" value when the former is higher in magnitude than the latter and a logic "−1" signal when the former is lower in magnitude than the latter; a P-I controller responsive to said binary signal for producing a ramp signal linearly increasing in response to the binary signal having the logic "1" value and decreasing in response to the binary signal having the logic "−1" value; a signal generator for producing a train of steady-state triangular pulses; and a pulse generator operative to compare said ramp signal with said triangular pulses for producing a train of square-shaped pulses as said first output signal when the ramp signal is higher in magnitude than said triangular pulses.

9. A mixture ratio control system as set forth in claim 8, said control circuit further comprising a wave modifier having an input terminal connected to the output terminal of said comparator and an output terminal electrically connected to said diaphragm assembly, said wave modifier being operative to produce as said second output signal a rectangular signal having a logic "1" value in response to said binary signal having the logic "1" value thereof and a logic "0" value in response to the binary signal having the logic "−1" value thereof, said solenoid-operated plunger being moved into the positions, respectively, corresponding to the maximum and minimum volume conditions of said variable-volume fuel reservoir chamber in response to the logic "1" and "0" values, respectively, of said rectangular signal.

* * * * *